United States Patent [19]

Johnson, Jr.

[11] Patent Number: 4,873,744

[45] Date of Patent: Oct. 17, 1989

[54] DOOR HINGE

[75] Inventor: Leonard E. Johnson, Jr., Elkhart, Ind.

[73] Assignee: L. E. Johnson Products, Inc., Elkhart, Ind.

[21] Appl. No.: 167,699

[22] Filed: Mar. 14, 1988

[51] Int. Cl.[4] ..... E05D 11/04

[52] U.S. Cl. ..... 16/247; 16/273; 16/387; 16/391

[58] Field of Search ..... 16/386, 387, 388, 389, 16/390, 391, 392, 247, 273, 223

[56] References Cited

U.S. PATENT DOCUMENTS

| | | | |
|---|---|---|---|
| 904,620 | 11/1908 | Van Dorn Kiple | 16/392 |
| 1,036,734 | 8/1912 | Sessions | 16/387 |
| 1,359,734 | 11/1920 | Parsons | 16/392 |
| 1,520,179 | 12/1924 | Ekman | 16/392 |
| 2,887,193 | 5/1959 | Sitler | 16/392 |
| 3,991,436 | 11/1976 | Nagase | 16/247 |

FOREIGN PATENT DOCUMENTS

| | | | |
|---|---|---|---|
| 0009024 | of 1889 | United Kingdom | 16/391 |

*Primary Examiner*—Richard K. Seidel

*Attorney, Agent, or Firm*—James D. Hall; Thomas J. Dodd; Todd A. Dawson

[57] ABSTRACT

A door hinge adapted for pivotally securing a door to a second door or a supporting frame in which the two hinge plates of the hinge are connected by pinned interengaging tab and knuckle parts so that at least two of the tab parts support at least two of the knuckle parts and provide bearing surfaces for the knuckle parts upon pivoting movement of the hinge plates.

6 Claims, 1 Drawing Sheet

DOOR HINGE

SUMMARY OF THE INVENTION

This invention reltes to a door hinge and will have specific but not limited application to a hinge for bi-fold doors.

Heretofore, hinges have been manufactured and sold which incorporate overlapping multiple knuckles extending from the respective hinge plates and interconnected by a pivot pin. Such hinges, while having good wearing capabilities when five or more knuckles are used, do require a substantial amount of material for forming. Lightweight door hinges such as those utilized for bi-fold doors may include flanges which extend from one of the hinge plates and which are positioned between the adjacent doors to provide spacing and location for the hinge. Such lightweight hinges instead utilize four overlapping knuckle parts. As such, either two knuckles or, depending upon the orientation of the hinge, a single knuckle bears or supports the weight imposed by the attached door. When a single knuckle is positioned so as to bear the entire weight of a door, substantial wear occurs in the hinge.

In this invention, the hinge is designed with one plate having at least three relative thin tab parts and the other plate having a knuckle positioned between each of the tab parts. This form enables the hinge to be oriented in any reversible vertical orientation with at least two tab parts supporting the knuckle parts of the hinge, thereby substantially reducing hinge wear and providing a more durable hinge.

Another aspect of this invention involves offsetting the inner face of the hinge about each of the screw or attachment holes in the hinge and interconnecting the offsets. This form of construction allows for a slight space or clearance between the hinge plate and the underlying door or support member for accommodating shavings or similar material as the attachment member, such as a screw, is driven or turned into the door or support member.

Accordingly, it is an object of this invention to provide a durable and economical door hinge.

Another object of this invention is to provide a door hinge which is for bi-fold doors and which includes multiple support areas in contact with the knuckle parts of the hinge.

Still another object of this invention is to provide a door hinge which incorporates elongated relief sections for accommodating shavings and similar materials when the hinge is attached to a door or a support member.

Other objects of this invention will become apparent upon a reading of the following description.

BRIEF DESCRIPTION OF THE DRAWINGS

A preferred embodiment has been chosen for purposes of illustration and description wherein.

DESCRIPTION OF THE PREFERRED EMBODIMENT

The preferred embodiment illustrated is not intended to be exhaustive or limit the invention to the precise form disclosed. It is chosen and described to best explain the principles of the invention to enable others skilled in the art to utilize the invention.

Figure 1:
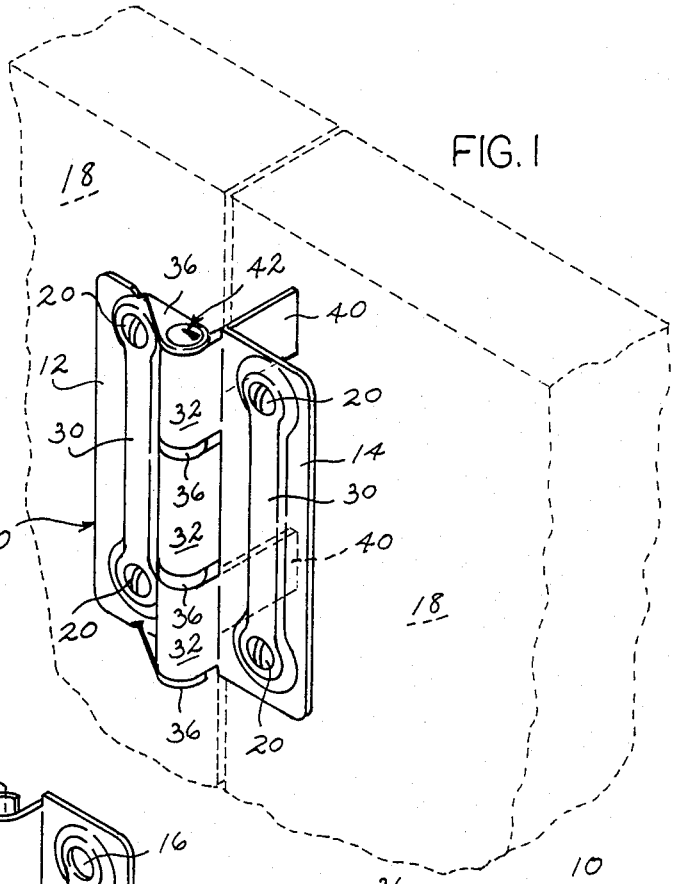
FIG. 1 is a perspective view of the hinge shown attached to a pair of bi-fold doors illustrated by the broken lines for purposes of orientation and to illustrate the environment in which the hinge may be utilized.
Figure 2:
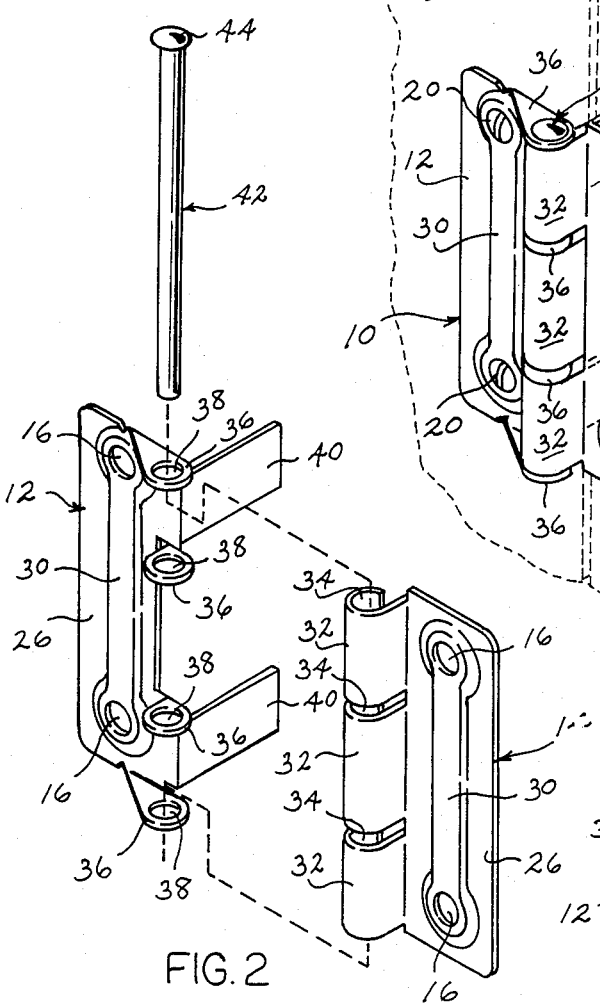
FIG. 2 is an exploded view of the component parts of the hinge.
Figure 3:
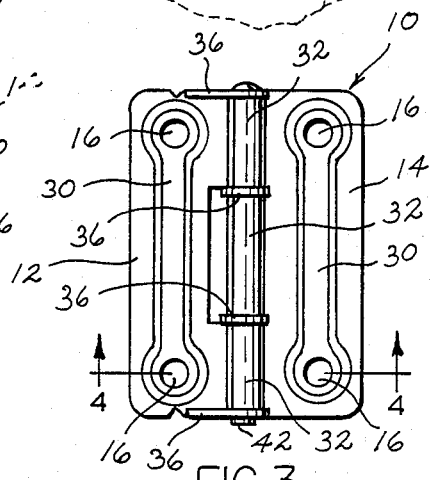
FIG. 3 is a front view of the hinge.
Figure 4:
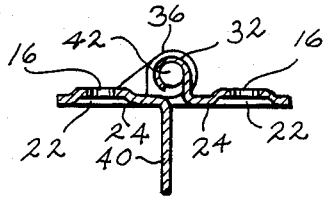
FIG. 4 is a sectional view take along line 4—4 of FIG. 3 of the hinge.

The door hinge 10 of this inventon includes plates 12 and 14. Each of the plates include openings 16 which enable the plate to be attached or secured to doors 18 shown in broken lines in FIG. 1 or to a door and another type support such as a door frame. Screws 20 or similar elongated securement devices extend through openings 16 in the hinge plates 12 and 14 and are turned or anchored into the underlying doors and supports.

A recess 22 is formed peripherally about each opening 16 in hinge plates 12 and 14 at the inner face 24 of the hinge plates. Each recess 22 is formed by a protrusion which projects from the outer face 26 of each hinge plate and is interconnected to another recess 22 by an embossed rib 30. Each rib 30 serves to reinforce the hinge plate and to provide a passage in hinge face 24 between recesses 22 to receive shavings, dust or other particulate matter when screws 20 are turned or driven into the underlying doors 18.

Plate 14 is formed so as to include three aligned knuckles 32 along one edge. Each knuckle 32 is sleeve like, having a center opening 34 which is aligned with each of the openings 34 in the other knuckles. Hinge plate 12 includes four parallel spaced apart tab parts 36 formed along an edge. Each tab 36 includes a center opening 38 with the openings 38 of the tabs being aligned. In the particular hinge construction shown, hinge plate 14 also includes a pair of rearwardly projecting flanges 40, each formed between two adjacent tab parts 36. Flanges 40 serve as locators and spacers when the hinge is utilized to connect bi-folding doors, such as doors 18.

Hinge 10 is assembled with knuckles 32 fitting between adjacent tab parts 36 and a pivot pin 42 inserting downwardly through the aligned openings 34 and 36 in the cooperatively engaging knuckle parts and tab parts. Pin 42 includes an enlarged head 44, which engages one of the outer most tab parts 36 of hinge plate 14, and extends beyond the opposite outer most tab part 36 where it maybe staked or otherwise deformed so as to prevent its withdrawal from the aligned openings 34 and 36 of the knuckle parts and tab parts. In this manner, hinge parts 12 and 14 are pivotally connected together by pin 42 so as to be axially rotatable about the pin.

In this construction, it will be observed that regardless of the vertical orientation of hinge 10, that is whether hinge plate 12 is to the left or to the right of the mounted hinge, there will always be three tab parts 36 which supportingly engage an overlying knuckle part 32, providing multiple bearing surfaces during supporting and rotative movement of the hinge. In this manner, the hinge may be located in either vertical orientation depending upon which side of the hinge one desires the tab parts 36 and flanges 40 to be located upon installation with at least two of the tab parts 36 serving to support an overlying knuckle part 32 of the hinge. If desired, a minimum of three tab parts and two interposed knuckle parts can produce a satisfactory result. By utilizing a combination of knuckle parts and cooperating tab parts, a hinge of minimal material and, thus, of economical construction can be produced.

It is to be understood that the invention is not to be limited to the details above described and given but may be modified within the scope of the following claims.

What I claim is:

1. A door hinge adapted to pivotally secure a door to a member, said hinge comprising first and second hinge plates adapted to be secured to said door and member respectively, one of said first and second hinge plates including only parallel spaced apart tab parts each having an opening aligned with a said opening in another tab part, the other of said first and second hinge plates including only spaced apart knuckle parts each having an opening aligned with said opening in another knuckle part, each knuckle part position between adjacent pairs of tab parts with said openings in the tab parts and knuckle parts being aligned, a pin extending through said aligned openings, two of said tab parts supportingly engaging two of said knuckle parts when said first and second hinge plates are secured to said door and member.

2. The door hinge of claim 1 wherein said one hinge plate has at least three of said tab parts and said other hinge plate has at least two of said knuckle parts.

3. Door hinge of claim 2 including four of said tab parts and three of said knuckle parts, three of said tab parts supportingly engaging three of said knuckle parts when said first and second hinge plates are secured to said door and member.

4. The door hinge of claim 3 and separator flange extending from a said hinge part, said flange constituting means for positioning between said door and member to selectively space the door or member from each other upon attachment of said hinge plate to the door or member.

5. The door hinge of claim 4 and a second said separator flange, each of said flanges extending from said one hinge plate between to adjacent tab parts thereof.

6. The door hinge of claim 1 wherein each hinge plate includes front and rear faces and spaced opening means extending from said front face to said rear face for accommodating fasteners to attach the plate to one of said door and member, recesses in the plate rear face about said opening means, recess means extending in said plate rear face between said first mentioned recesses to accommodate pieces of said door or member as said fastener is inserted into the door or member.

* * * * *